US006296064B1

(12) United States Patent
Janusz et al.

(10) Patent No.: US 6,296,064 B1
(45) Date of Patent: Oct. 2, 2001

(54) AXIALLY LOADED DRIVE TOOL

(75) Inventors: Michael Janusz, Elgin; David C. Goss, Rockford, both of IL (US)

(73) Assignee: Textron Inc., Providence, RI (US)

( * ) Notice: Subject to any disclaimer, the term of this patent is extended or adjusted under 35 U.S.C. 154(b) by 0 days.

(21) Appl. No.: 09/680,761

(22) Filed: Oct. 6, 2000

Related U.S. Application Data

(60) Provisional application No. 60/173,347, filed on Dec. 28, 1999.

(51) Int. Cl.[7] ..... B27B 17/00; B25C 3/00

(52) U.S. Cl. ..... 173/30; 173/11; 173/18; 173/170; 227/119; 227/36; 81/57.37

(58) Field of Search ..... 173/30, 11, 13, 173/18, 29, 170; 81/57.37, 431; 227/119, 139, 142

(56) References Cited

U.S. PATENT DOCUMENTS

| | | | | |
|---|---|---|---|---|
| 2,723,835 | * | 11/1955 | Reese et al. | 173/30 |
| 3,802,517 | * | 4/1974 | Cooke-Yarborough | 173/18 |
| 3,960,191 | | 6/1976 | Murray . | |
| 4,236,555 | | 12/1980 | Dewey . | |
| 4,246,939 | | 1/1981 | Boegel . | |
| 4,354,403 | | 10/1982 | Boëgel et al. . | |
| 4,397,412 | | 8/1983 | Dewey . | |
| 4,402,369 | * | 9/1983 | Nikitin et al. | 173/30 |
| 5,605,423 | | 2/1997 | Janusz . | |
| 5,897,045 | | 4/1999 | Olvera et al. . | |

* cited by examiner

*Primary Examiner*—Scott A. Smith
(74) *Attorney, Agent, or Firm*—Trexler, Bushnell, Giangiorgi & Blackstone & Marr, Ltd.

(57) ABSTRACT

A drive tool having a top portion which is engageable with a drive source and a lower portion engageable with a fastener. The drive tool includes an axial load assist mechanism configured to urge the lower portion and upper portion of the tool away from each other (i.e. relative movement) such that a generally axial force is applied to the fastener engaged with the lower portion of the tool. As a result, the amount of upper body axial force an operator must apply to the drive tool to install the fastener is reduced.

16 Claims, 16 Drawing Sheets

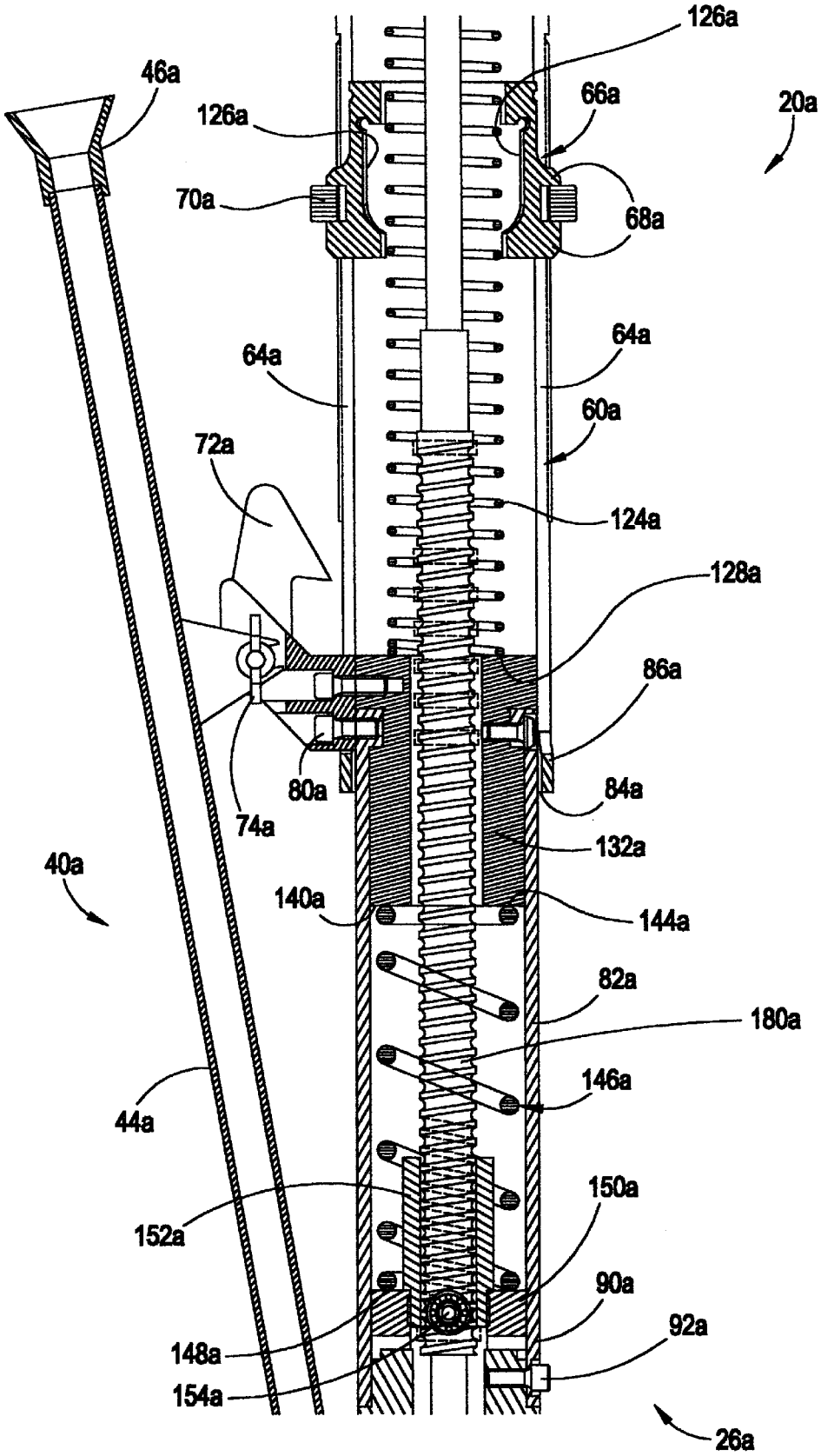
FIG. 8"

AXIALLY LOADED DRIVE TOOL

RELATED APPLICATION

This application claims tie benefit of U.S. Provisional Application Ser. No. 60/173,347, filed Dec. 28, 1999.

BACKGROUND

The present invention relates generally to drive tools for installing fasteners, and relates more specifically to a drive tool including an axial load assist mechanism that effectively reduces the amount of upper body effort an operator must apply to the drive tool to install a fastener.

Typically (and definitely with regard to self-drilling, self-tapping fasteners), when an operator uses a drive tool, such as a drill, to drive a fastener into a work piece, the operator must use his upper body strength to apply an axial force to the drive tool. It is advantageous to reduce the amount of upper body strength an operator must apply to a drive tool to effect the installation of a fastener because doing so reduces the fatigue and physical stress experienced by the operator. This is especially true because oftentimes a large number of fasteners must be installed to complete a job.

Some drive tools are configured such that, if an operator wishes to use the drive tool to install a fastener into a floor, the operator must get on the floor, on his or her knees, in order to use the drive tool to drive the fastener into the floor. Of course, getting on one's knees every time one installs a fastener in a floor can be uncomfortable and tedious. This is especially true in the case where a large number of fasteners must be installed over a large floor surface area.

Other drive tools, such as those which are disclosed in U.S. Pat. Nos. 3,960,191; 4,236,555; and 5,897,045 are configured such that an operator can remain standing while using the drive tool to install fasteners into a floor. Such drive tools are essentially extended tools connected to a power drill or to some other driving source. Typically, the drive tool is configured such that fasteners are automatically fed to the end of the drive tool. This provides that the operator can use the drive tool to install a plurality of fasteners without having to bend over each time to place a fastener at the end of the tool. Unfortunately, such drive tools are typically relatively heavy and the operator must apply substantial upper body effort to apply the necessary axial force to the drive tool to install a fastener. Therefore, using such a drive tool, especially if an operator must use the drive tool everyday for extended periods of time, can be tiring.

In some cases, the type of job to be performed using such a drive tool increases the resulting fatigue experienced by the operator. For example, U.S. Pat. No. 5,605,423 discloses the installation of fasteners in a composite deck system. Such a composite deck system is used in building construction, and provides that a corrugated deck is placed over structural supports, and fasteners are driven into the composite deck material to fasten it to the structural supports. Because the deck is corrugated, the operator must lift the drive tool over each upward standing corrugation portion to drive a course of fasteners into the underlying structural supports. This process requires competitive bending and shifting of weight over the drive tool, and can be tiring. As might be expected, such repetitive action can cause competitive motion problems for the operator.

Those drive tools which are configured such that an operator can remain standing while using the drive tool to install fasteners into a floor are not typically adaptable to a variety of substrate (e.g., floor or decking) profiles, and do not typically provide a stable and perpendicular platform for installing a fastener.

OBJECTS AND SUMMARY

Accordingly, it is an object of an embodiment of the present invention to provide a drive tool including an axial load assist mechanism that effectively reduces the amount of upper body effort an operator must apply to the drive tool to install a fastener.

Another object of an embodiment of the present invention is to provide a drive tool configured such that an operator can easily use his or her own body weight to apply an axial load during a drilling operation.

Still another object of an embodiment of the present invention is to provide a drive tool which is adaptable to a variety of substrate (e.g., floor or decking) profiles, and which provides a generally stable and perpendicular platform for installing a fastener.

Briefly, and in accordance with one or more of the foregoing objects, an embodiment of the present invention provides a drive tool having a top portion which is engageable with a drive source and a lower portion which is engageable with a fastener. The drive tool includes an axial load assist mechanism configured to urge the lower portion and upper portion of the tool away from each other (i.e. relative movement) such that a generally axial force is applied to the fastener engaged with the lower portion of the tool. As a result, the amount of upper body axial force applied by an operator to the drive tool to install the fastener is reduced.

Preferably, the axial load assist mechanism of the drive tool includes a threaded shaft carrying a thrust nut. The thrust nut is configured such that,during drilling, the thrust nut compresses a spring inside the drive tool, and the force of the spring acting on the thrust nut provides that the lower portion and upper portion of the drive tool are urged away from each other (i.e. relative movement). As a result, a generally axial force is applied to the fastener engaged with the lower portion of the tool, thereby reducing the amount of upper body axial force an operator must apply to the drive tool to install the fastener.

Still further, preferably the lower portion of the drive tool includes foot pads on which an operator may stand. Hence, the operator can use his or her own body weight to apply an axial load during a drilling operation.

Still even further, preferably the lower portion of the drive tool includes adjustable height supports to allow the drive tool to be adaptable to a variety of substrate (e.g., floor or decking) profiles, and provide a generally stable and perpendicular platform for installing a fastener. The lower portion of the drive tool may include wheels to facilitate the transporting of the drive tool between fastening and to and from each job. Preferably, the drive tool includes a feeder for automatically feeding fasteners to the end of the lower portion of the drive tool so that an operator does not have to bend over each time a fastener is to be installed using the drive tool.

BRIEF DESCRIPTION OF THE DRAWINGS

The organization and manner of the structure and function of the invention, together with further objects and advantages thereof, may be understood by reference to the following description taken in connection with the accompanying drawings, wherein.

DESCRIPTION

Figure 1:
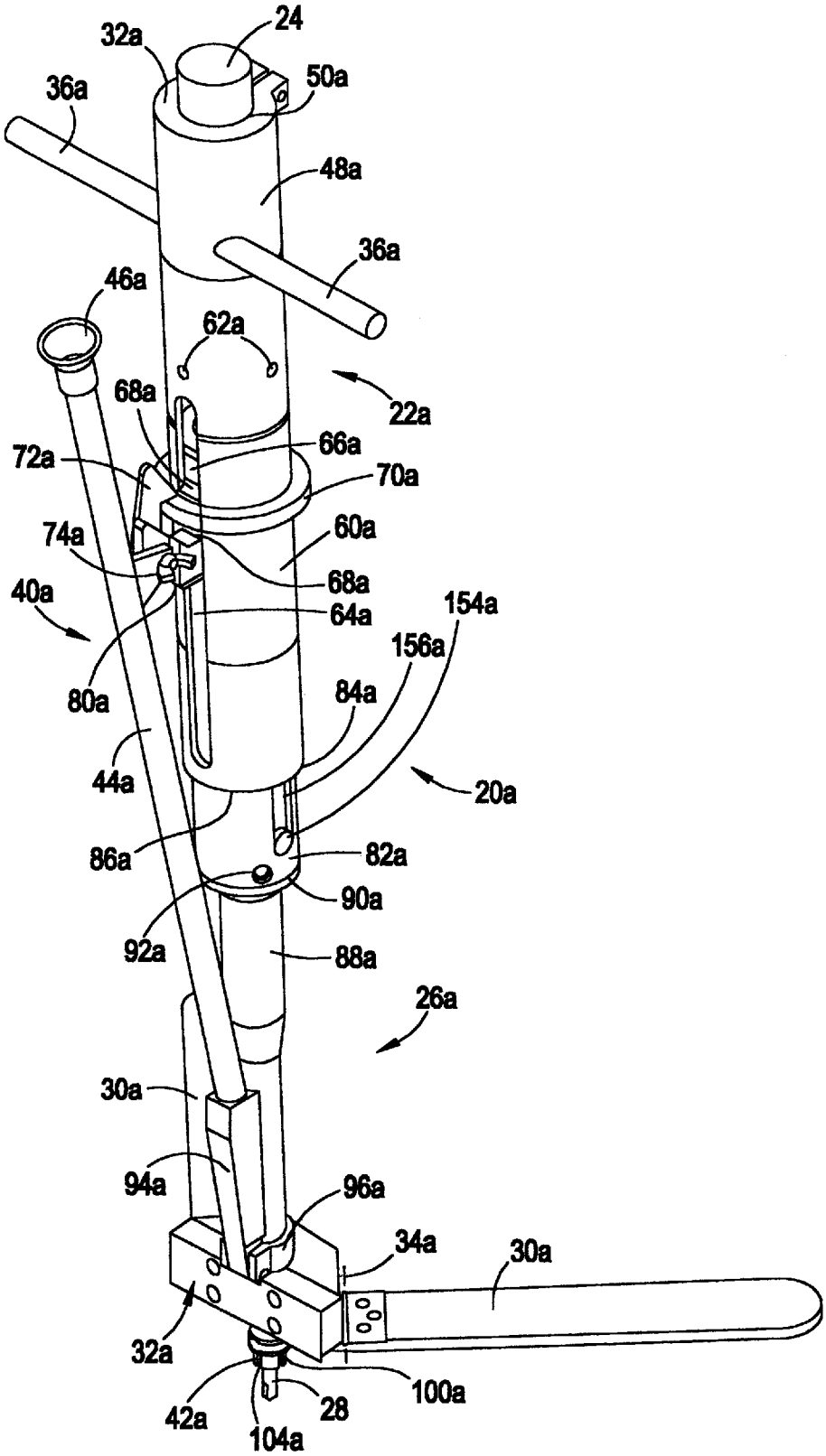
FIG. 1 is a perspective view of a drive tool in accordance with an embodiment of the present invention.
Figure 2:
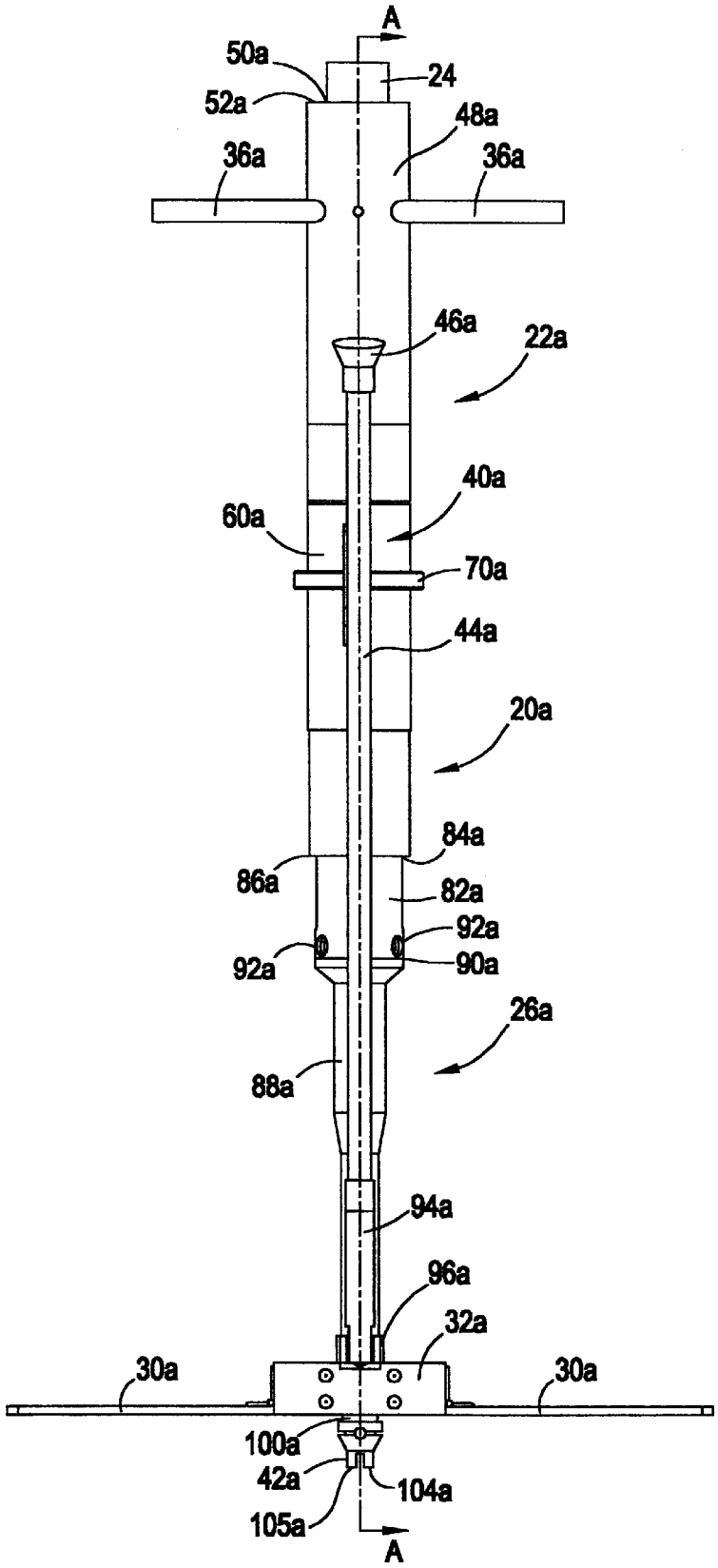
FIG. 2 is front elevational view of the drive tool illustrated in FIG. 1.

While the present invention may be susceptible to embodiment in different forms, there is shown in the drawings, and herein will be described in detail, embodiments of the invention with the understanding that the present description is to be considered an exemplification of the principles of the invention and is not intended to limit the invention to that as illustrated and described herein.

Figure 9:
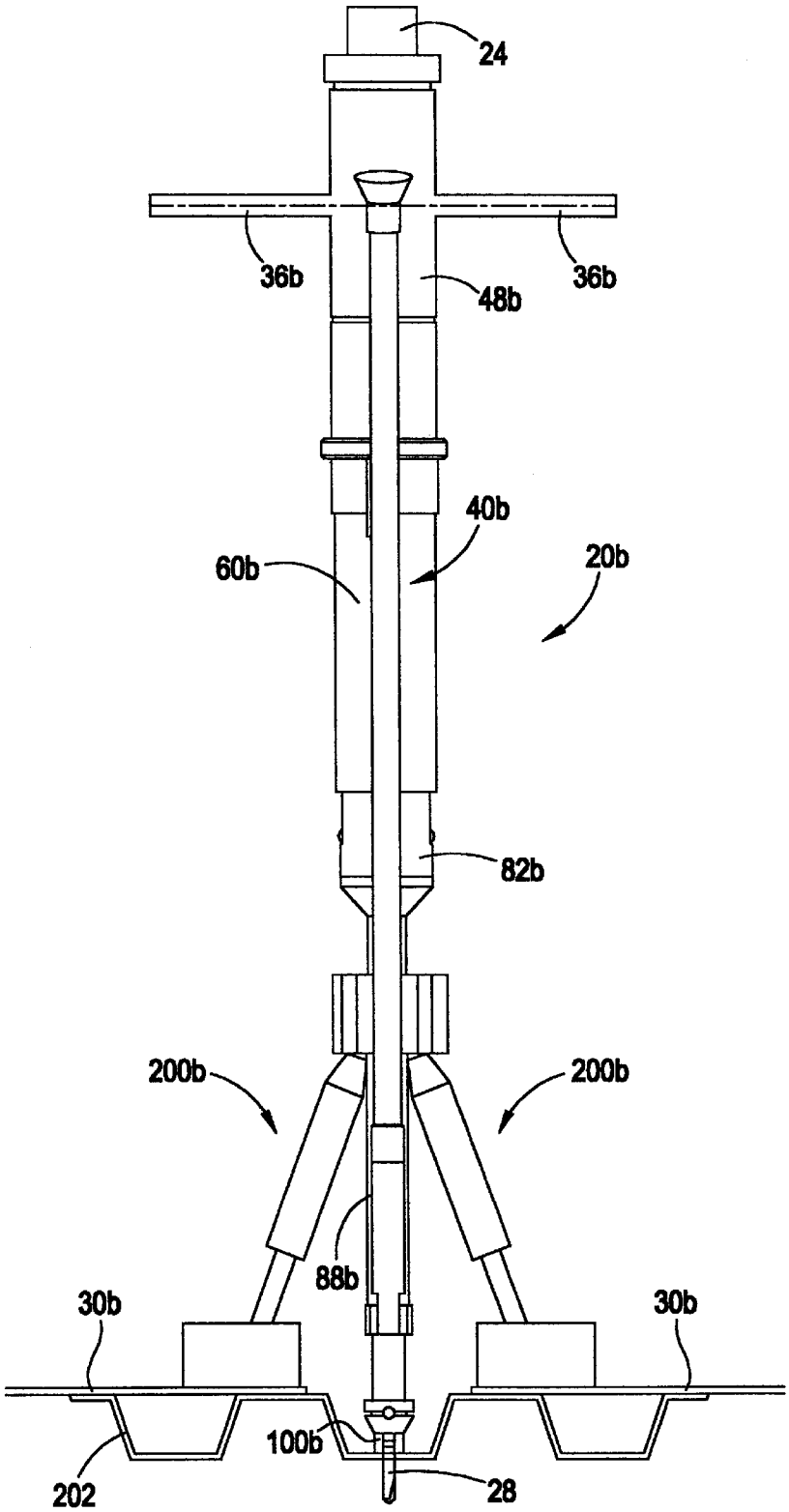
FIG. 9 is front elevational view of a drive tool in accordance with another embodiment of the present invention, wherein the drive tool includes adjustable height supports.
Figure 10:
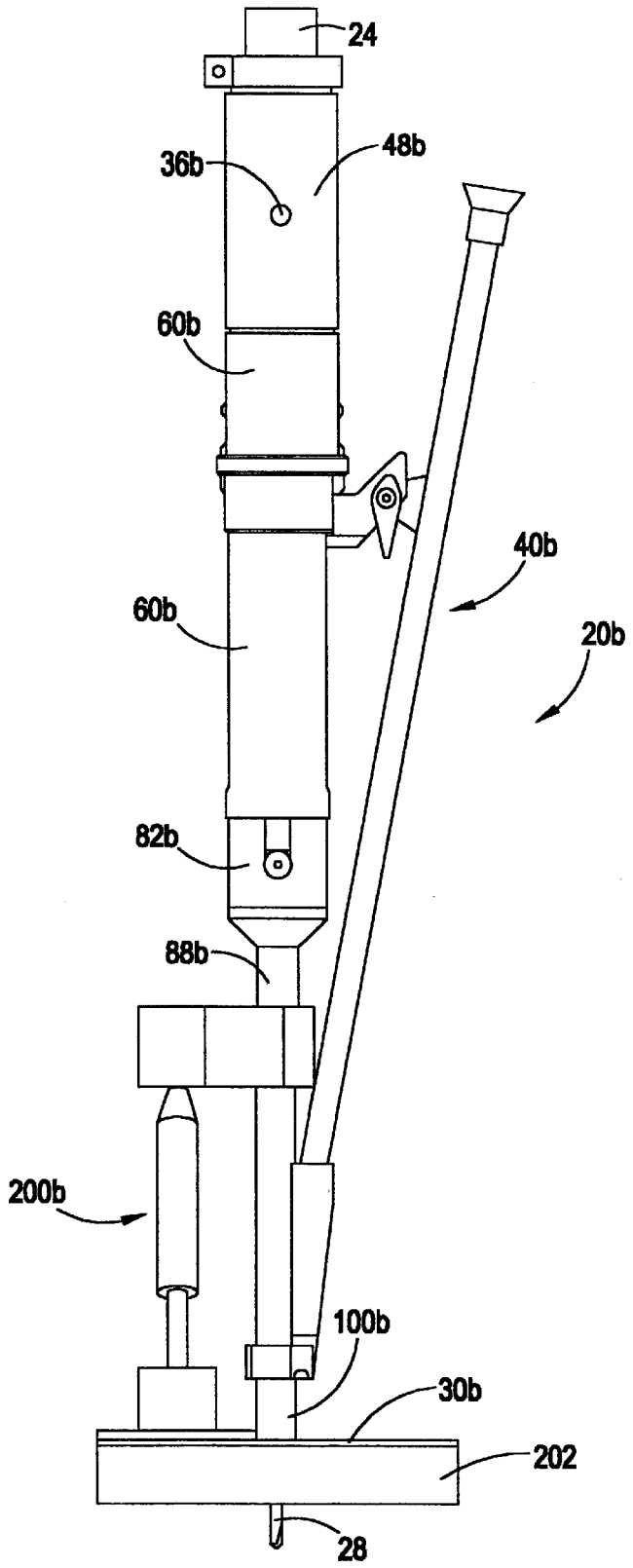
FIG. 10 is a side elevational view of the drive tool illustrated in FIG. 9.
Figure 11:
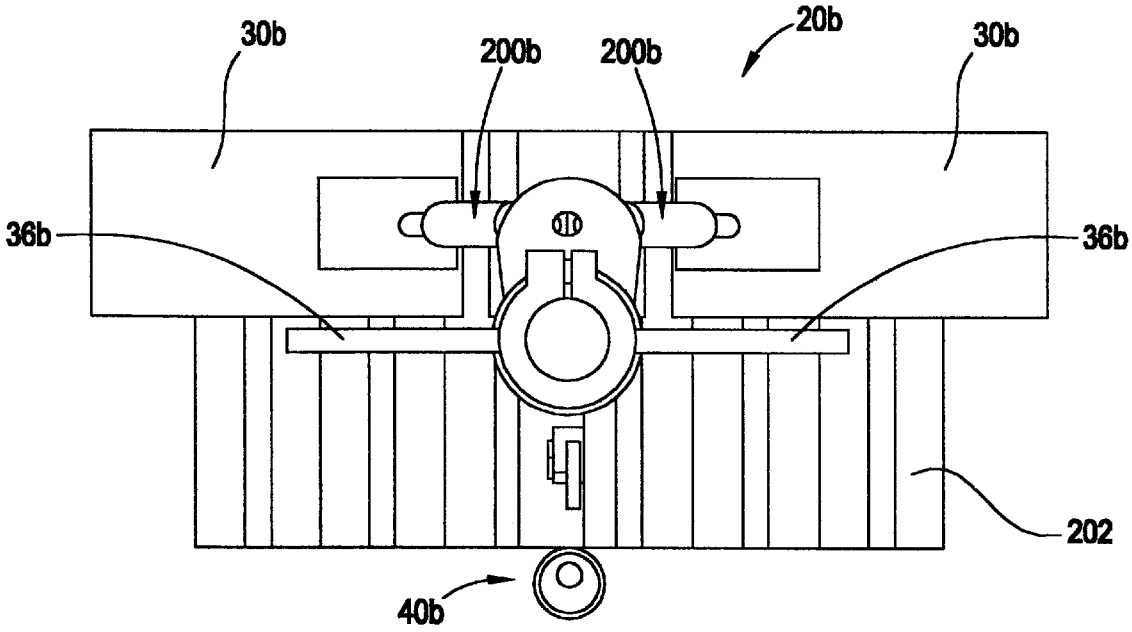
FIG. 11 is a top plan view of the drive tool illustrated in FIGS. 9 and 10.
Figure 12:
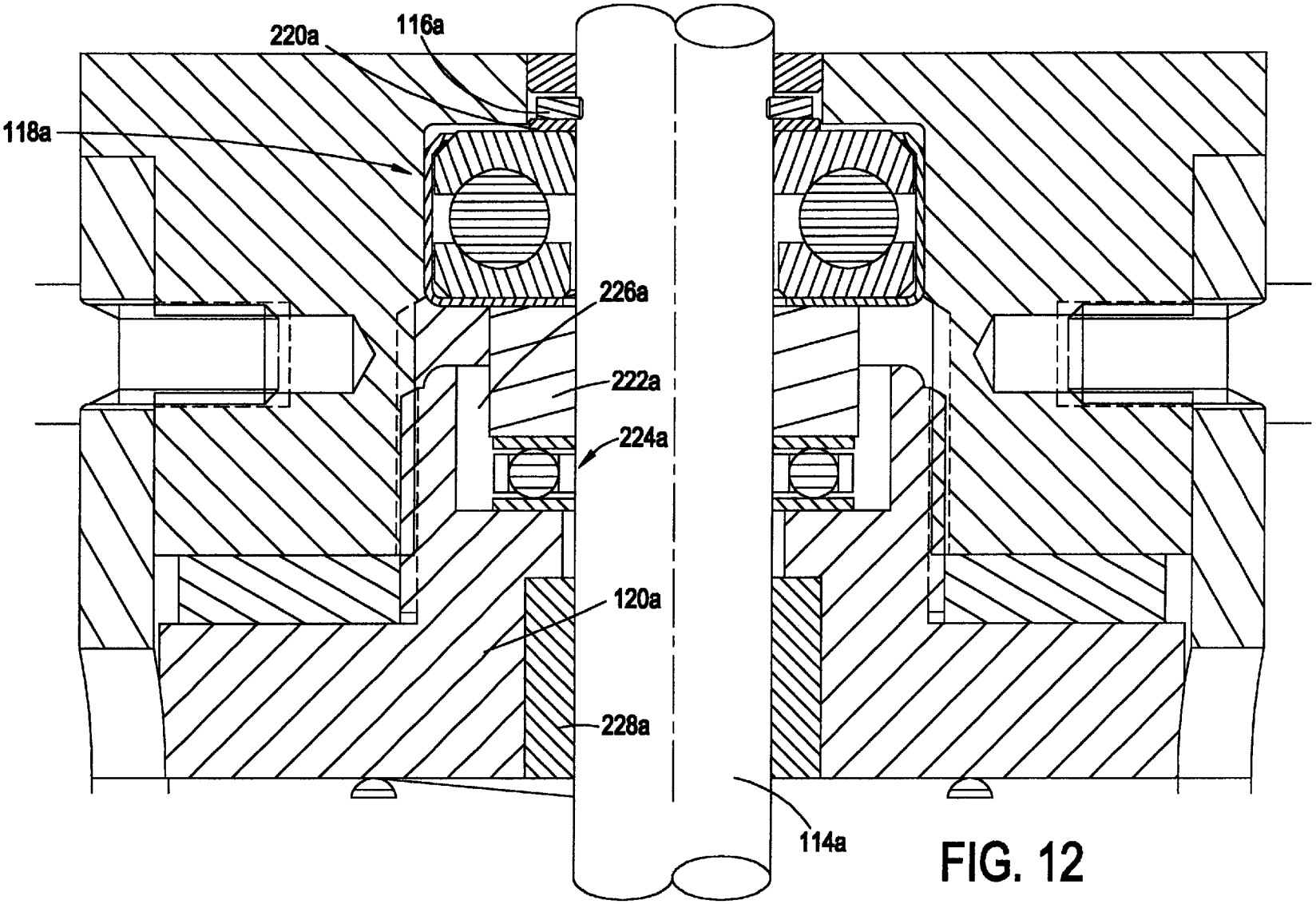
FIG. 12 is a cross-sectional view of an alternative construction of a circled portion of FIG. 7.

Shown in the Figures are two drive tools 20*a* and 20*b* each of which is in accordance an embodiment with the present invention. Specifically, FIGS. 1–4 illustrate a drive tool 20*a* in accordance with a first embodiment of the present invention, and FIGS. 9–11 show a drive tool 20*b* in accordance with a second embodiment of the present invention. FIGS. 5–8 (FIG. 8 consists of FIGS. 8', 8" and 8'") are cross-sectional views applicable to either one of the drive tools 20*a* or 20*b* illustrated in FIGS. 1–4 or 9–11. FIG. 12 depiets an alternate construction of a portion of either one of the drive tools 20*a* or 20*b*.

Figure 13:
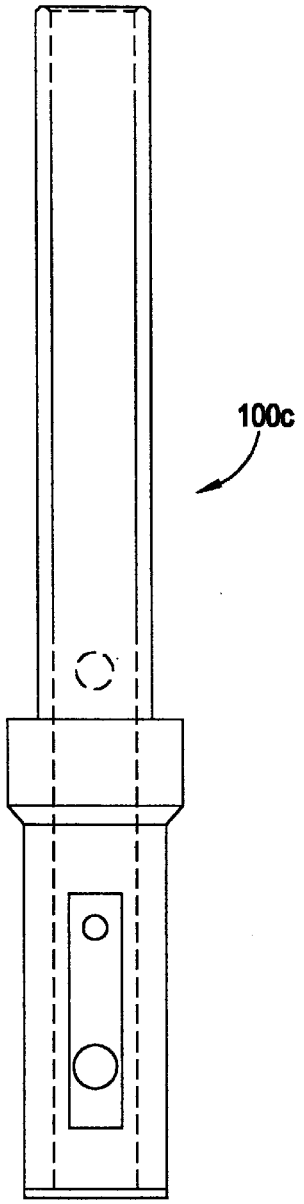
FIGS. 13 and 14 are side views of an alternative nosepiece which can be employed in connection with the drive tools appearing in the previous Figures, where the nosepiece includes slots which eliminate the need to lift the drive tool over an installed fastener.
Figure 14:
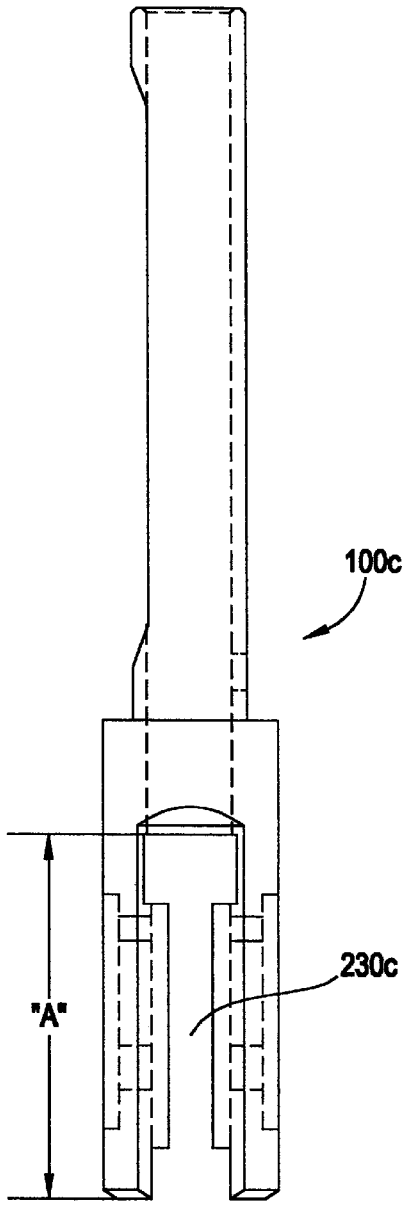
Figure 15:
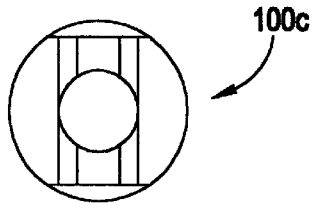
FIG. 15 is a top view of the nosepiece shown in FIG. 14.

FIGS. 13–15 depict an alternate nosepiece which can be used with either drive tool 20*a* or 20*b*. Each drive tool 20*a*, 20*b* is configured such that an operator can use the drive tool 20*a*, 20*b* to drive a fastener into a work piece. As will be described, each drive tool includes an axial load assist mechanism that effectively reduces the amount of upper body axial force an operator must apply to the respective drive tool to install a fastener.

The drive tool 20*a* shown in FIGS. 1–4 will be described first, and then the drive tool 20*b* shown in FIGS. 9–11 will be described. In the following description, like reference numerals are used to identify like parts, and different alphabetic suffixes (i.e., "a" and "b") are used for each of the different embodiments. At times, a detailed description of a part is omitted with the understanding that one may review the description relating to a corresponding part of the other embodiment.

Figure 5:
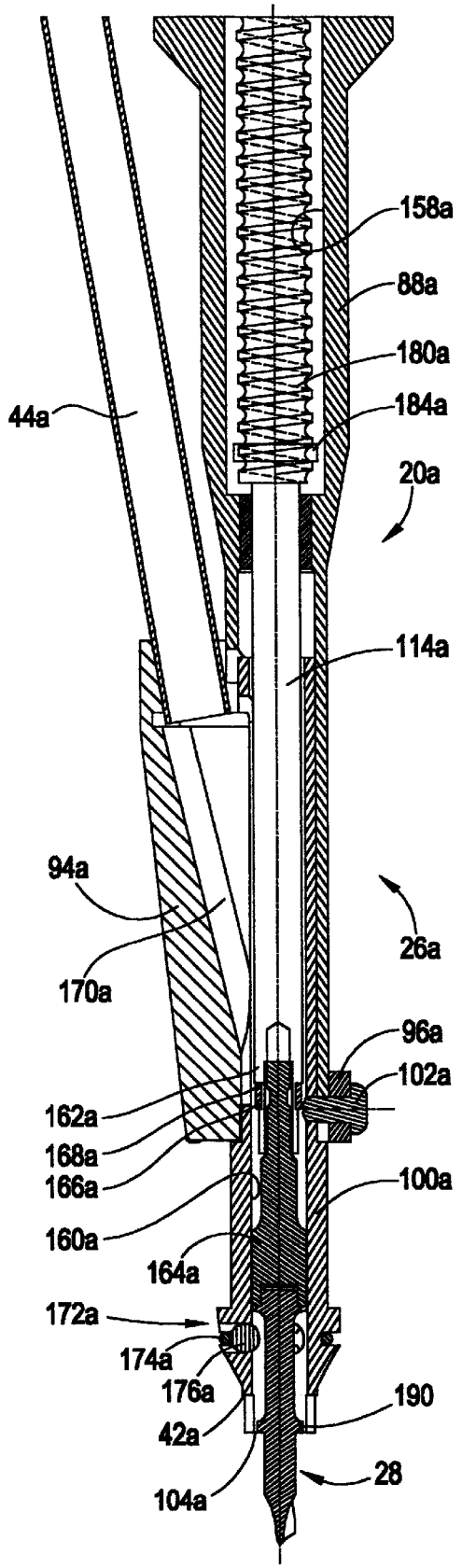
FIG. 5 is an enlarged cross-sectional view of a bottom portion of the drive tool which is shown in FIGS. 1–4.
Figure 7:
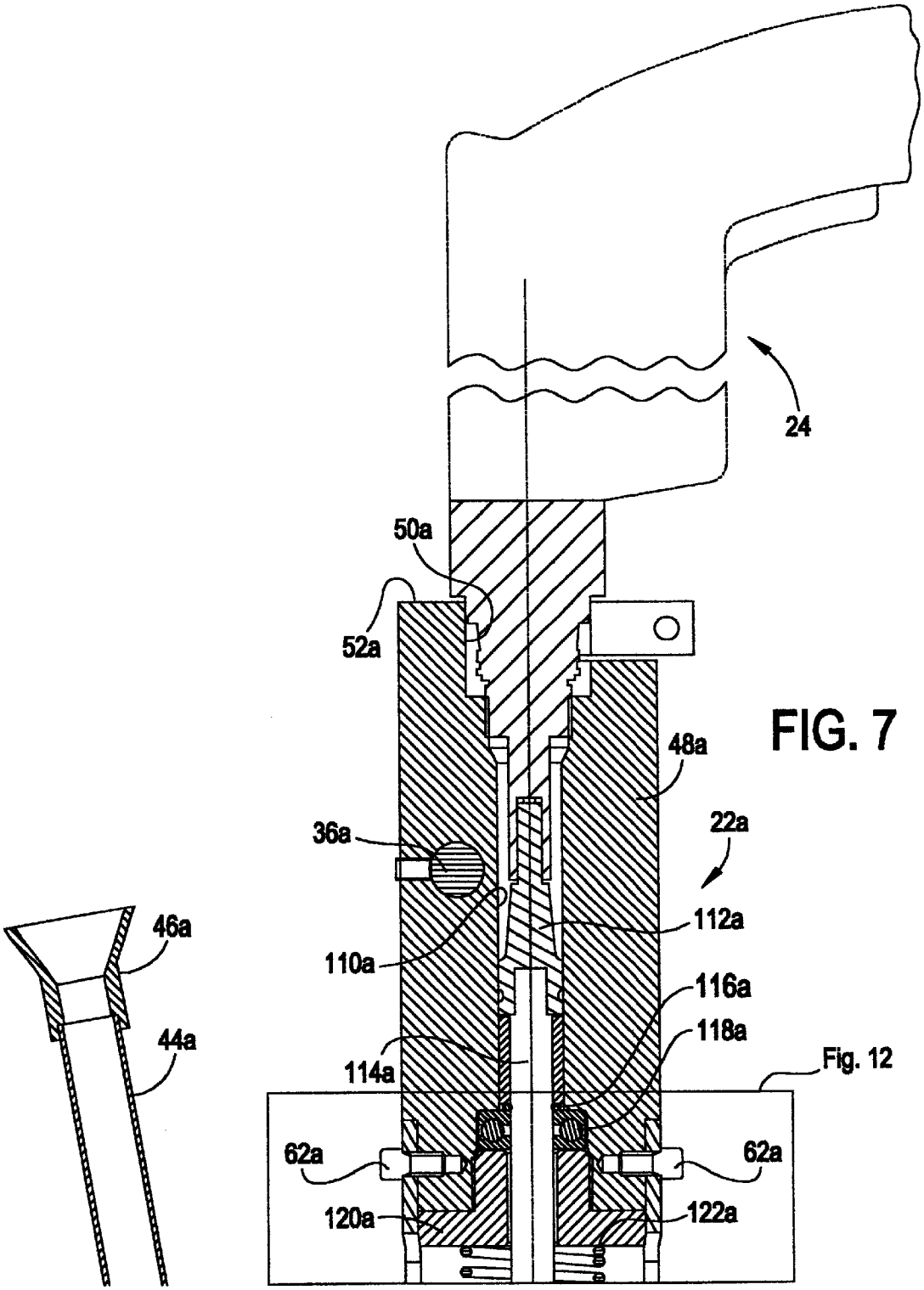
FIG. 7 is an enlarged cross-sectional view of a top portion of the drive tool which is shown in FIGS. 1–4.
Figure 8:
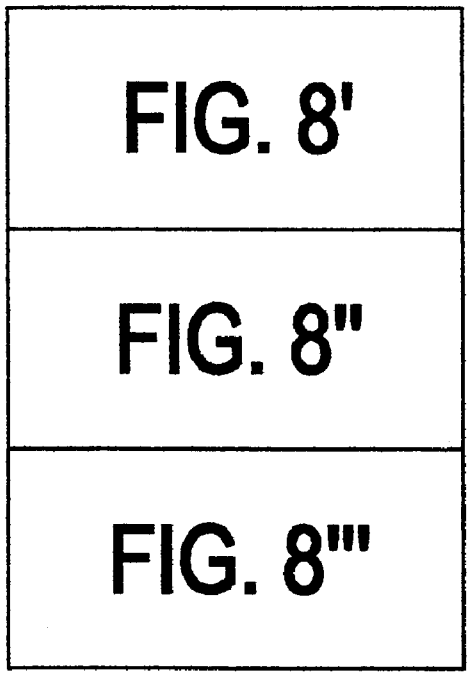
FIG. 8 (consisting of FIGS. 8', 8" and 8'") is a cross-sectional view of the drive tool illustrated in FIGS. 1–4, taken along line A—A of FIG. 2, showing a fastener installed in one end of the drive tool and a drive source connected to the other end of the drive tool, and showing the drive tool immediately before a drilling operation is begun.
Figure 8:
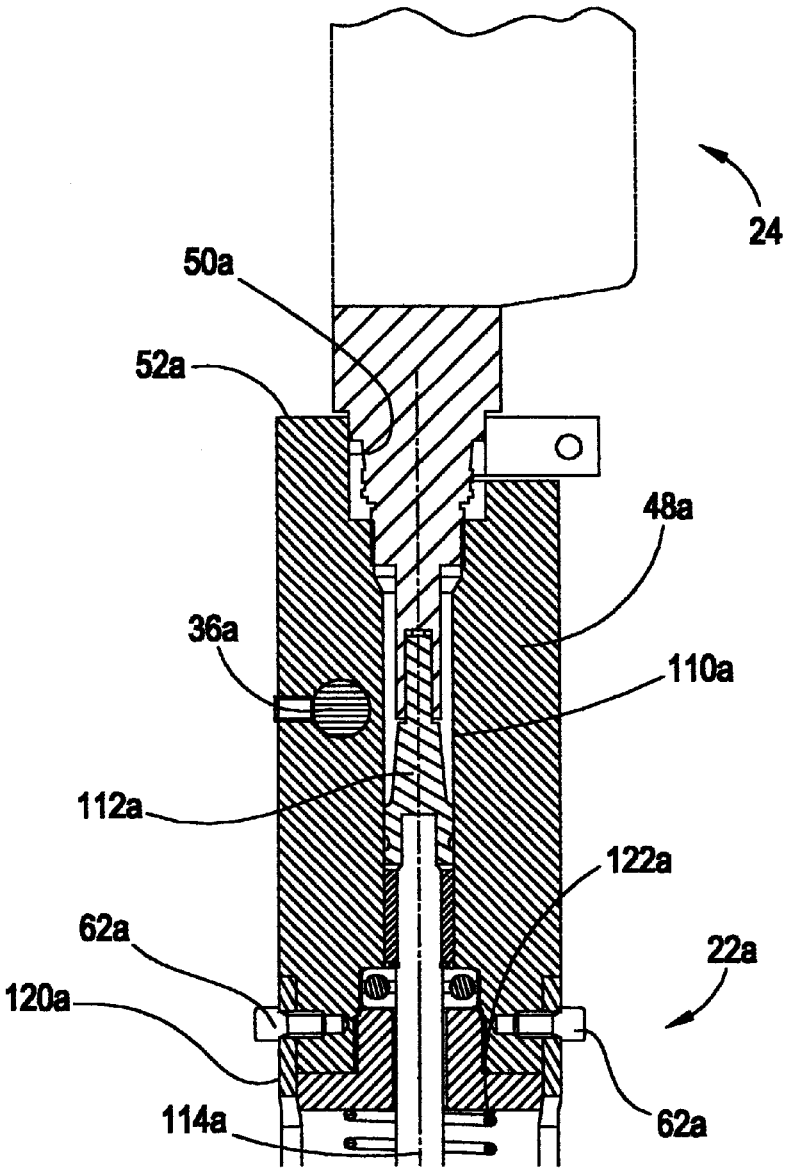
Figure 8:
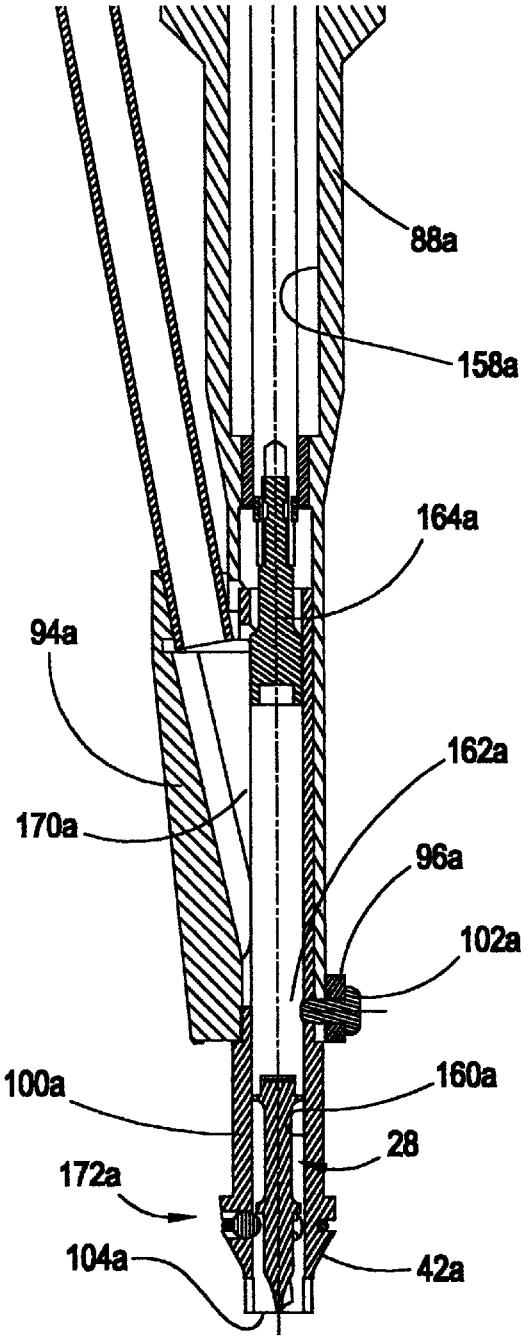

The drive tool 20*a* shown in FIGS. 1–4 includes an upper end 22*a* which is configured for engagement with a drive source 24, such as with a power drill (see FIGS. 3, 7 and 8—a portion of the drive source 24 is shown in FIGS. 1–4), and includes a lower end 26*a* which is configured to receive a fastener 28 (see FIGS. 1, 5 and 8). The drive tool 20*a* provides that an operator can engage the drive source 24 with the upper end 22*a* of the drive tool 20*a*, and operate the drive source 24 to cause the drive tool 20*a* to drive the fastener 28 into a work piece.

As shown in FIGS. 1–4, the drive tool 20*a* preferably includes foot pads 30*a* on which the operator can stand when operating the drive tool 20*a* (the foot pads 30*a* are omitted from FIGS. 5–8). As a result, the operator can use his or her own body weight to apply an axial load to the fastener 28 while using the drive tool 20*a* to drive the fastener 28 into a work piece. Preferably, each foot pad 30*a* extends from a bracket 32*a* which is attached to the lower end 26*a* of the drive tool 20*a*, and each foot pad 30*a* is pivotable about an axis 34*a* such that the foot pads 30*a* can be pivoted upward into a non-operating position, and can be pivoted downward into an operating position (this position is shown in FIGS. 1–4). Specifically, a flat back utility hinge may connect each foot pad 30*a* to the bracket 32*a* and provide that each foot pad 30*a* is pivotable. Preferably, each hinge is formed of standard steel and has a zinc plated finish.

As shown in FIGS. 1–4 (see also FIGS. 7 and 8), preferably the drive tool 20*a* includes handles 36*a* extending outwardly from the upper end 22*a* of the drive tool 20*a*. The handles 36*a* allow an operator to readily grip the drive tool 20*a* during use. The handles 36*a* also facilitate transportation of the drive tool 20*a*, such as the transportation of the drive tool 20*a* at a given job site, as well as the transportation of the drive tool 20*a* from one job site to another.

Preferably, as shown in FIGS. 1–8, an automatic fastener feeding mechanism 40*a* is in communication with the lower end 26*a* of the drive tool 20*a*. The automatic fastener feeding mechanism 40*a* is preferably configured to automatically feed fasteners 28 to the end 42*a* of the drive tool 20*a* so that an operator need not bend over and engage a fastener with the end 42*a* of the drive tool 20*a* each time the drive tool 20*a* is to be used to drive a fastener 28 into a work piece.

As shown, the automatic fastener feeding mechanism 40*a* may comprise a gravity feed tube 44*a* that includes a funnel end piece 46*a* to facilitate the deposit of fasteners 28 into the feed tube 44*a*. As such, the feed tube 44*a* essentially functions as a conduit between the standing operator and the end 42*a* of the drive tool 20*a*. Alternatively, the automatic fastener feeding mechanism 40*a* may comprise a magazine feed tube or a cartridge feeder.

As shown in FIGS. 1–3, 7 and 8, the upper end 22*a* of the drive tool includes a housing 48*a*. As shown in FIGS. 7 and 8, the housing 48*a* includes an opening 50*a* at an end 52*a* thereof for receiving the drive source 24, such as for receiving the driven, rotating portion of a power drill.

Figure 6:
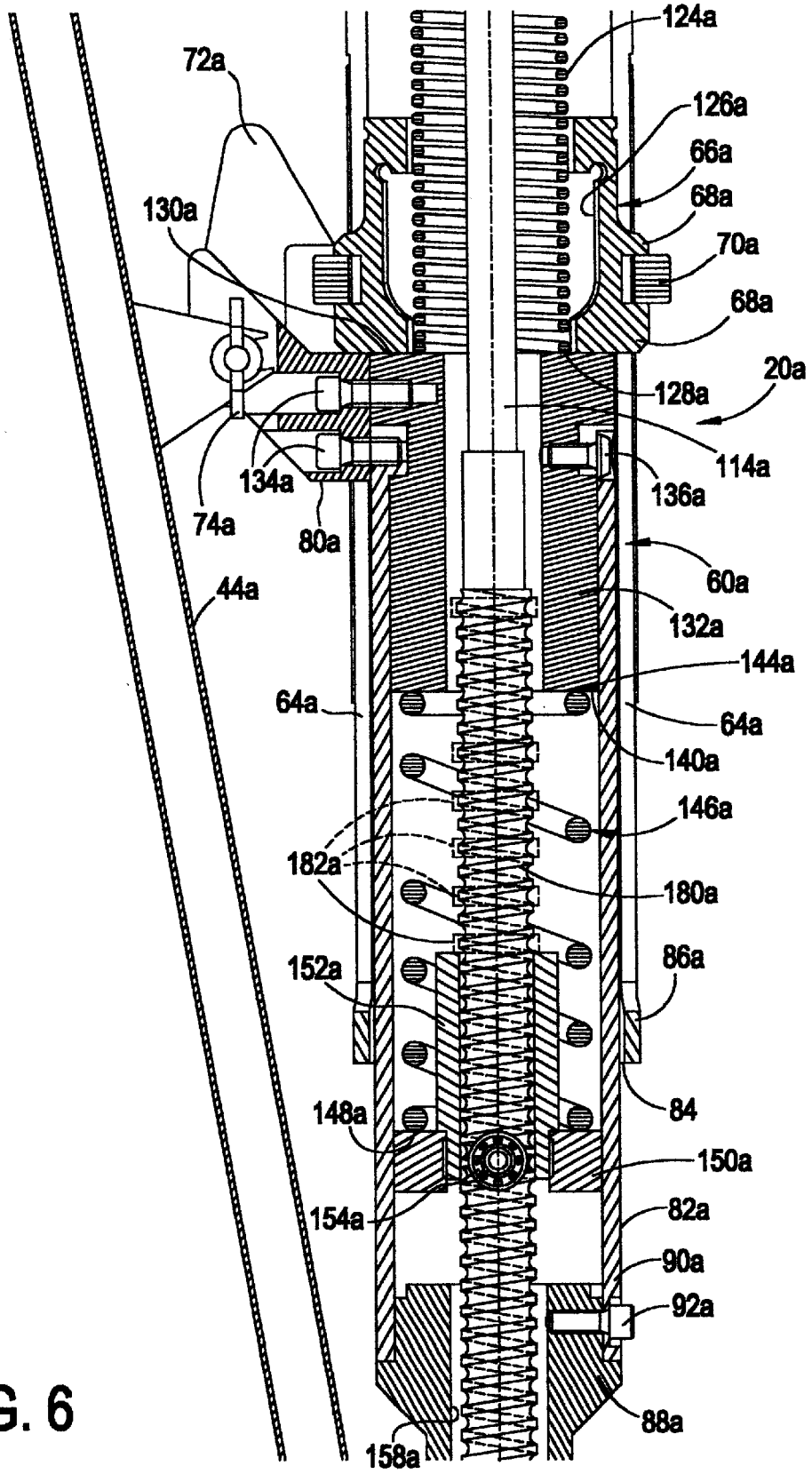
FIG. 6 is an enlarged cross-sectional view of a middle portion of the drive tool which is shown in FIGS. 1–4.

As shown in FIGS. 1 and 6–8, the housing 48*a* is attached to an upper tube 60*a* (via securing members 62*a*), and the upper tube 60*a* includes a pair of opposing slots 64*a* (see FIGS. 1, 6 and 8). Preferably, a yoke 66*a* is disposed in the upper tube 60*a* and protrusions 68*a* thereof extend through the opposing slots 64*a* in the upper tube 60*a*. An adjusting nut 70*a* is engaged with the protrusions 68*a* of the yoke 66*a*, and a latch 72*a* is engageable with the adjusting nut 70*a*. Preferably, the latch 72*a* is connected to the feed tube 44*a* via a wing nut 74*a* and provides that engaging the latch 72*a* with the adjusting nut 70*a* places the drive tool 20*a* in a locked, generally inoperable position as shown in FIGS. 5–7 (the drive tool 20*a* will be placed in such a position only during periods of non-operation—such as during service). The latch 72*a* and feed tube 44*a* are connected to a stop bracket 80*a* extending from one of the slots 64*a* in the upper tube 60*a*.

As shown in FIGS. 1–3, 6 and 8, a lower tube 82*a* extends from an opening 84*a* in the bottom end 86*a* of the upper tube 60*a* such that the lower tube 82*a* essentially telescopes from the opening 84*a*. Specifically, the lower tube 82*a* extends from the opening 84*a* in the upper tube 60*a* and is moveable relative to the upper tube 60*a* during a drilling operation. This will be described more fully herein.

A bottom tube or neck 88*a* is connected to a lower end 90*a* of the lower tube 82*a* (via securing members 92*a*), and, as shown in FIGS. 1–3, 5 and 8, a shuttle 94*a* effectively connects the lower end 42*a* of the gravity feed tube 44*a* to the bottom tube 88*a*. As shown, the bracket 32*a* which carries the foot pads 30*a* may be attached to the nosepiece or end piece 100*a*, and a shuttle 94*a* may be attached to the bottom tube 88*a* via a shuttle bracket 96*a* which is attached to the bottom tube 88*a* and the nose piece 100*a* with a button head screw 102*a*. Hence, the button head screw 102*a* also attaches the end piece 100*a* to the bottom tube 88*a*. Preferably, the button head screw 102*a* provides that the end piece 100*a* can be relatively easily removed from the bottom tube 88*a* and replaced. The end piece 100*a* ultimately receives the fasteners from the feed tube 44*a* (see FIGS. 1, 5 and 8), and the fasteners 28 exit an opening 104*a* in the end 42*a* of the end piece 100*a* when they are installed using the drive tool 20*a*. As shown, preferably the opening 104*a* includes four slots which allow "chip relief" (i.e., allow chips to escape from under the drill tool 20*a* during drilling).

As discussed above, the housing 48*a* at the top of the drive tool 20*a* has an opening 50*a* configured for receiving a drive source 24, such as the rotating, driven end of a power drill. As shown in FIGS. 7 and 8, the opening 50*a* leads to a through bore 110*a* in the housing 48*a*, and an adaptor 112*a* is in the through bore 110*a*. The adaptor 112*a* engages the drive source 24 and a shaft or ball screw 114*a* extending a substantial length of the drive tool 20*a*, and essentially forms a coupling between the drive source 24 and the shaft 114*a*. A ring 116*a* and thrust bearing 118*a* are also disposed in the housing 48*a* (see FIG. 7).

A nut 120*a* engages the end of the housing 48*a* (see FIG. 7), generally opposite the drive source 24, and the nut 120*a* engages an end 122*a* of an upper spring 124*a* disposed in the upper tube 60*a*. The upper spring 124*a* extends through a bore 126*a* in the yoke 66*a*, and an opposite end 128*a* of the upper spring 124*a* engages a top surface 130*a* of a bottom tube cap 132*a*. The upper spring 124*a* provides that the drive tool 20*a* can accommodate fasteners of various lengths. As shown in FIG. 7 (see also FIG. 8), the stop bracket 80*a*, attached to the latch 72*a* and feed tube 44*a*, is secured to the lower tube 82*a* and bottom tube cap 132*a* (via securing members 134*a*). As shown, the lower tube 82*a* is also attached to the bottom tube cap 132*a* via securing member 136*a*.

Figure 3:
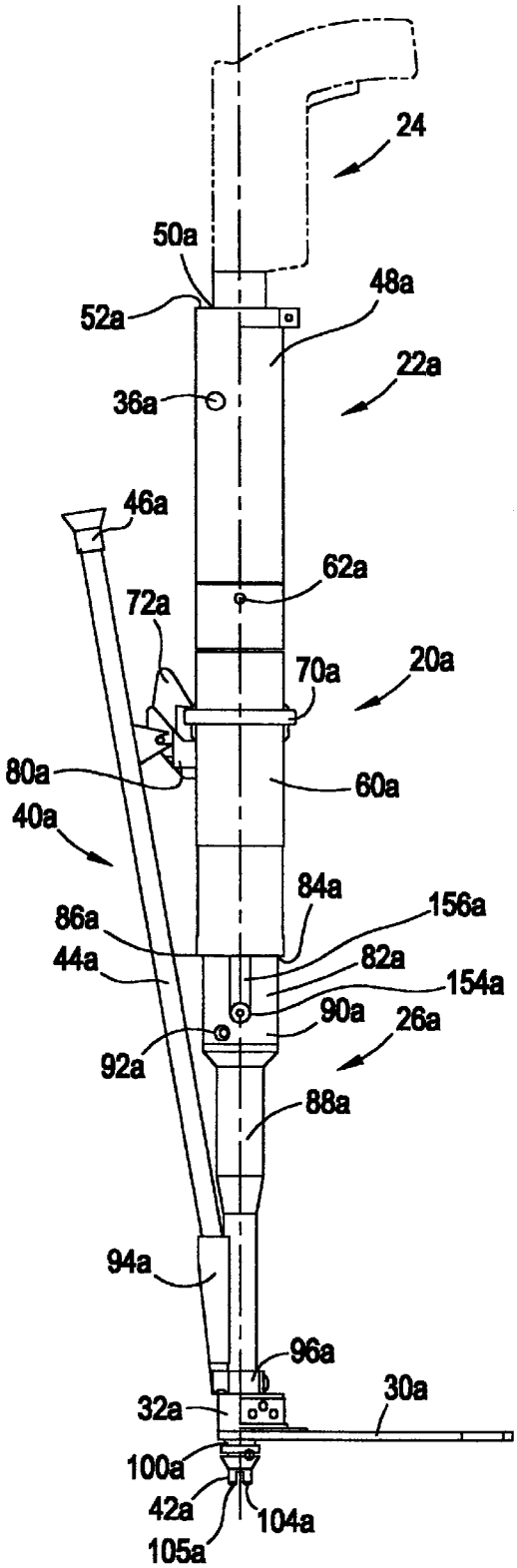
FIG. 3 is a side elevational view of the drive tool illustrated in FIGS. 1 and 2.
Figure 4:
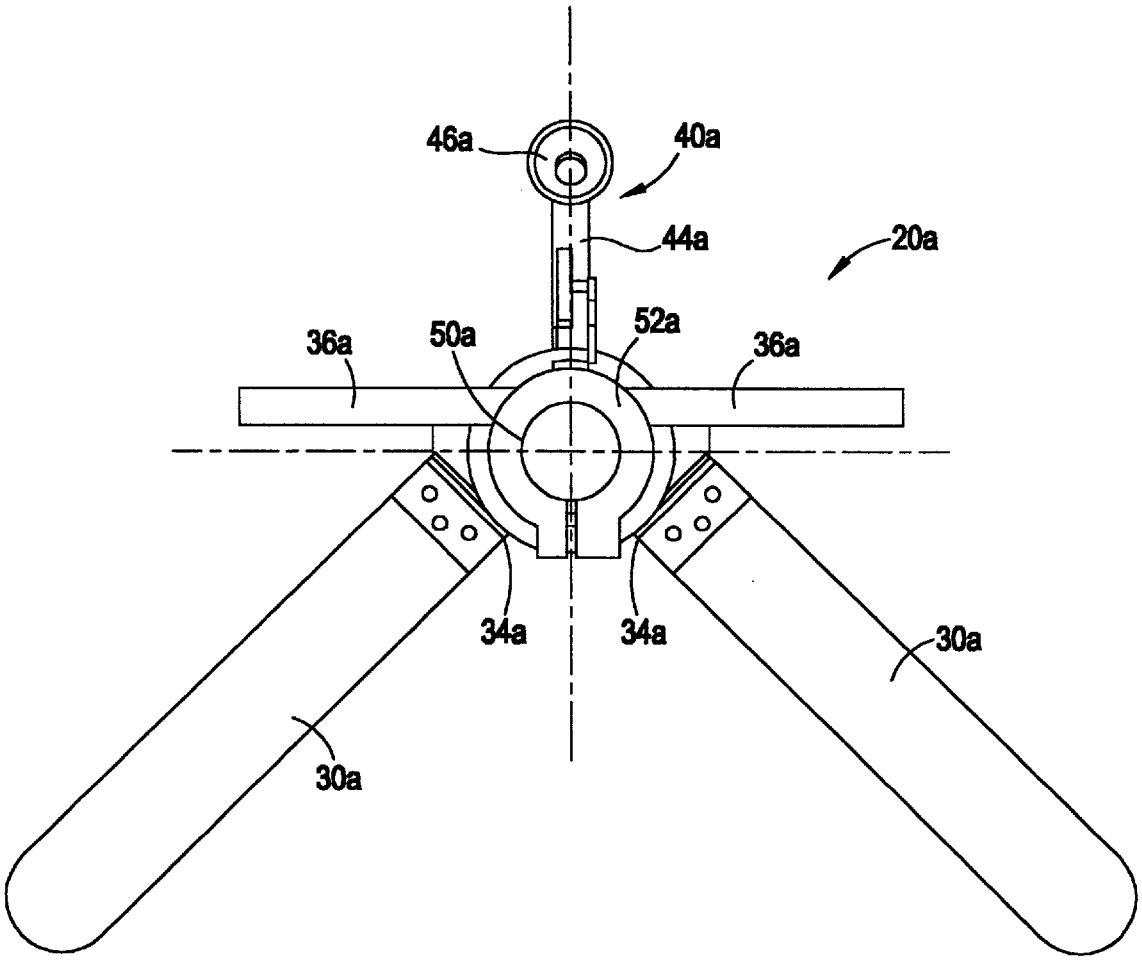
FIG. 4 is a top plan view of the drive tool illustrated in FIGS. 1–3.

A bottom surface 140*a* of the bottom tube cap 132*a* engages an upper end 144*a* of a lower spring 146*a*, and a lower end 148*a* of the lower spring 146*a* engages a ball screw thrust nut 150*a* which is threadably engaged with the shaft or ball screw 114*a*. Preferably, tie lower spring 146*a* is application specific, i.e. has a structure and configuration ideal for the intended application of the drive tool 20*a*. The ball screw thrust nut 150*a* is preferably engaged with a ball nut 152*a* via two assemblies 154*a* generally 180 degrees apart. Preferably, each assembly 154*a* includes a ball bearing, mounting pins and a retaining ring, and each assembly 154*a* extends through a corresponding slot 156*a* in the lower tube 82*a* as shown in FIGS. 1 and 3 (only one side is shown, but the other is identical).

The shaft or ball screw 114*a* extends from the adaptor 112*a*, through the nut 120*a*, the upper spring 124*a*, the bottom tube cap 132*a*, the lower spring 146*a*, and into bores 158*a* and 160*a* in the bottom tube 88*a* and end piece 100*a*. As shown in FIGS. 5 and 8, an end 162*a* of the shaft or ball screw 114*a* is engaged with a drive bit 164*a* or nut driver in the end piece 100*a*, and the drive bit 164*a* engages the fastener 28 to be installed using the drive tool 20*a*. As shown, preferably a retaining ring 166*a* and ball bearing 168*a* retain the drive bit 164*a* with the end 162*a* of the shaft 114*a*. Preferably, the engagement is such that the drive 164*a* bit can be easily replaced.

As shown, the shuttle 94*a* provides a passageway 170*a* extending between the gravity feed tube 44*a* and the bore 160*a* in the end piece 100*a*, and the passageway 170*a* provides that a fastener 28 can travel from the gravity feed tube 44*a* to the bore 160*a* in the end piece 100*a*. Preferably, a fastener retaining structure 172*a* is provided in the end-spiece 100*a* for engagement with the fastener 28 when the fastener 28 is disposed in the end piece 100*a*. Specifically, the fastener retaining structure 172*a* may comprise an o-ring 174*a* and steel ball 176*a*. Preferably, the fastener retaining structure 172*a* allows any unwanted fasteners in the end piece 100*a* to be easily removed.

As shown in FIGS. 5, 6 and 8, at least a portion of the shaft or ball screw 114*a* is threaded, and the thrust nut 150*a* in the lower tube 82*a* is threadably engaged with the threaded portion 180*a* of the shaft 114*a*. As shown in FIGS. 5 and 8, split or stop pins 182*a* and 184*a*are disposed on the threaded portion 180*a* of shaft 114*a*, and the thrust nut 150*a* is disposed between the two split pins 182*a* and 184*a*. Preferably, the shaft 114*a* includes several hole for receiving an upper-most split pin 182*a* such that the upper-most split pin 182*a* is adjustable (multiple positions of the upper-most split pin 182*a* are shown in FIGS. 6 and 8). The split pins 182*a*, 184*a* essentially define the range of travel of the thrust nut 150*a* along the threaded portion 180*a* of the shaft 114*a* during a drilling operation. Therefore, adjusting the location of the upper-most split pin 182*a* changes the range of travel of the thrust nut 150*a* along the threaded portion 180*a* of the shaft 114*a*. Preferably, the position of the upper-most split pin 182*a* is adjusted depending on the desired resulting compression force on the lower spring 146*a*. Providing that the upper-most split pin 182*a* is adjustable provides the drive tool 20*a* with the capability of optimizing the installation of a variety of fasteners into a variety of substrates.

To use the drive tool 20*a* to drive a fastener 28 into a work piece, an operator engages a drive source 24 with the end 52*a* of the housing 48*a*, and if engaged as shown in FIG. 6, disengages the latch 72*a* from the adjusting nut 70*a* (Typically, the latch 72*a* will be engaged only when an operator wants to service the tool for maintenance). Disengagement of the latch 72*a* from the adjusting nut 70*a* causes the drive tool 20*a* to expand to the position shown in FIGS. 5–7. Specifically, the upper spring 124*a* expands in the upper tube 60*a*, thereby pushing the upper tube 60*a* and lower tube 82*a* apart (via the force the spring 124*a* applies to the nut 120*a* at the end of the housing 48*a* and to the top surface 130*a* of the bottom tube cap 132*a*).

Then, the operator pivots the foot pads 30*a* into the operating position, as shown in FIGS. 1–4, and drops one or more fasteners 28 into the gravity feed tube 44*a*. Preferably, the operator drops a fastener 28 having a flange thereon 190 as shown in FIGS. 5–8. Specifically, the fastener 28 may be a self-drilling fastener, such as a fastener consistent with that which is shown and described in U.S. Pat. Nos. 5,605,423, which is incorporated herein in its entirety by reference.

The fastener 28 moves from the gravity feed tube 44*a*, through the passageway 170*a* in the shuttle 94*a*, and into the bore 160*a* in the end piece 100*a*, to the position shown in FIG. 8. As shown, preferably the fastener 28 drops into a position such that the flange 190 on the fastener 28 contacts the steel ball 176*a* in the end piece 100*a*. The steel ball 176*a* prevents the fastener 28 from exiting prematurely from the opening 104*a* in the end 106*a* of the end piece 100*a*, and positions the fastener for engagement by the socket and prevents the fastener from sticking out of the nosepiece prematurely.

Thereafter, the operator manipulates the drive tool 20*a* such that the end of the fastener 28 is disposed against the work piece, at the location at which the operator wants to install the fastener 28. Then, the operator operates the drive source 24 to cause the adaptor 112*a*, shaft 114*a* and drive bit 164*a* to rotate. As the shaft 114*a* rotates, the thrust nut 150*a* travels up the threaded portion 180*a* of the shaft 114*a*, thereby compressing the lower spring 146*a* in the lower tube 82*a*, between the thrust nut 150*a* and the bottom tube cap 132*a*. The thrust nut 150*a* does not rotate along with the shaft 114*a* due to the fact that the assemblies 154*a* which are engaged with the thrust nut 150*a* extend out the slots 156*a* in the lower tube 82*a* as shown in FIGS. 1 and 3 (only one side is shown, but the other is identical).

Should the thrust nut 150*a* contact one of the split pins 182*a*, 1 84*a* on the shaft 114*a*, preferably the thrust nut 150*a* spins free on the shaft 114*a*, thereby preventing further travel of the thrust nut 150*a* in the same direction along the shaft 114*a*. In other words, when the thrust nut 150*a* contacts a split pin 182*a*, 184*a*, the thrust nut 150*a* stops moving axially along the shaft 114*a* and instead spins free or axially idles. Hence, the split pins 182*a*, 184*a* define the range of motion of the thrust nut 150*a* along the threaded portion 180*a* of the shaft 114*a*.

As the drive tool 20*a* drives the fastener 28 into the work piece, an upward force is imparted on the lower tube 82*a* (as a result of the compression of the lower spring 146*a* therein). The operator may counter this upward force by holding onto the handles 36*a* and standing on the foot pads 30*a* (see FIGS. 1–4). Further rotation of the shaft 114*a* once the collar 150*a* contacts a split pin 182*a*, 184*a* causes the upper tube 60*a* to telescope downwardly over the lower tube 82*a*. The combination of the spring loaded force by the lower spring 146*a* acting downwardly on the thrust nut 150*a* and the operator force on the foot pads 30*a* of the drive tool 20*a* forces the fastener 28 beyond the steel ball 176*a* in the end piece 100*a*, and drives the fastener 28 into the work piece.

While the fastener 28 is being driven into the work piece, the compression of the lower spring 146*a*, and the pressing of the end 148*a* of the lower spring 146*a* on the thrust nut 150*a*, imparts an axially directed force along the shaft 114*a*. More specifically, the compression of the lower spring 146*a* effectively imparts a generally axial resulting force on the fastener 28 being driven into the work piece by the drive tool 20*a*. Hence, the lower compression spring 146*a* and corresponding structure provides an axial load assist mechanism that effectively reduces the amount of upper body axial force an operator must apply to the drive tool 20*a*. Hence, the operator can use the drive tool 20*a* to install fasteners more quickly and with less effort. Preferably, the lower spring 146*a* creates a generally constant axial spring load throughout the drilling and thread forming process. Additionally, during drilling and tapping, preferably a constant force is kept on the fastener, and ball nut 152*a* is hold freewheeling at pin 182*a* during the entire drill tap time. Preferably, the spring applies a constant axial load resulting in fast drill and tapping times.

Once the fastener has been driven into the work piece, the operator can step off the foot pads 30*a* and the drive tool 20*a* will return to the starting position (due to the force of spring 146*a* against nut 150*a*, as shown in FIG. 6). Alternatively, the drive tool 20*a* can be configured such that the drive source 24 must be driven in the other direction to return the drive tool 20*a* to the starting position which is shown in FIG. 8. At this point, another fastener 28 is fed to the end piece 100*a* from the gravity feed tube 44*a*, or the operator may place the drive tool 20*a* in the locked position as shown in FIGS. 5–7.

The drive tool 20*b* shown in FIGS. 9–11 is similar to the drive tool 20*a* shown in FIGS. 1–4. In fact, the cross-sectional views shown in FIGS. 5–8, described above in connection with the drive tool 20*a* shown in FIGS. 1–4, are also applicable to the drive tool 20*b* shown in FIGS. 9–11. As such, the drive tool 20*b* shown in FIGS. 9–11 includes a housing 48*b*, handles 36*b* which extend from the housing 48*b*, an upper tube 60*b*, a lower tube 82*b*, a bottom tube 88*b*, an end piece 100*b*, an automatic fastener feeding mechanism 40*b* and foot pads 30*b*.

In fact, the only major difference between the drive tool 20*b* shown in FIGS. 9–11 and the drive tool 20*a* shown in FIGS. 1–4 is that the drive tool 20*b* shown in FIGS. 9–11 includes adjustable height supports 200*b* which extend from the bottom tube 88*b* of the drive tool 20*b* to a substrate or work piece 202, such as decking, wherein the substrate is adjacent the location at which the operator wants to install a fastener 28. As shown in FIGS. 9 and 11, the adjustable height supports 200*b* are configured to contact the substrate 202 during drilling. The engagement of the height supports 200*b* with the substrate 202 provides a generally stable and perpendicular platform for installing a fastener, and provides that the installed fastener can resist a higher withdrawal load. Additionally, by providing that the height supports 200*b* are adjustable provides that the drive tool 20*b* is effectively adaptable to a variety of substrate profiles.

Although not shown in FIGS. 9–11, the drive tool 20*b* can also be provided with wheels generally proximate the bottom of the tool 20*b* for facilitating the transportation of the tool 20*b*—both between fastenings at a given site and from one site to another.

FIG. 12 depicts an alternate construction for a portion of either drive tool 20*a* or 20*b*. The portion is identified in FIG. 7 with a circle. As shown in FIG. 13, a hardened washer 220*a* can be provided between the ring 116*a* and thrust bearing 118*a*, and a split locking collar 222*a* and thrust hearing 224*a* can be provided, seated in a counter bore 226*a*. Additionally, a sleeve bearing 228*a* (e.g., bronze) can be provided between the shaft 114*a* and nut 120*a*.

FIGS. 13–15 depict an alternate nosepiece 100*c* which can be employed with either drive tool 20*a* or 20*b*. As shown in FIG. 14, the nosepiece 100*c* includes a transverse through slot 230*c* which provides that after a fastener is installed, the drive tool 20*a*, 20*b* need not be picked up to clear the fastener. In contrast, the tool can be shifted sideways, with the head of the installed fastener clearing the end of the tool by sliding through the slot 230*c*. Such a construction is particularly usefull when longer fasteners are to be installed. Without such a nosepiece-construction, the entire tool may need to be lifted to clear the length of the fastener which is extending upward. The dimension "A" shown in FIG. 14 may be specifically configured to accommodate various length fasteners (i.e. "A" can be 2.25 inches, 2.75 inches, 3.25 inches, 3.75 inches, 4.25 inches, etc.).

While embodiments of the present invention are shown and described, it is envisioned that those skilled in the art may devise various modifications without departing from the spirit and scope of the foregoing description.

What is claimed is:

1. A drive tool having an upper portion which is engageable with a drive source and a lower portion which is engageable with a fastener, said drive tool comprising: a threaded shaft; a thrust nut on said threaded shaft; a spring, said thrust nut configured such that, during drilling, the thrust nut compresses the spring inside the drive tool, and a force of the spring acting on the thrust nut provides that the lower portion and upper portion of the drive tool are urged away from each other; stop structures on the threaded shaft, said stop structures defining a range of travel of said thrust nut, wherein at least one of the stop structures are adjustable, thereby providing that a resulting compression force provided by said spring during operation of said drive tool is adjustable.

2. The drive tool as recited in claim 1, further comprising foot pads on which an operator may stand.

3. The drive tool as recited in claim 2, wherein the foot pads are pivotable between a non-operating position and an operating position.

4. The drive tool as recited in claim 2, wherein the foot pads are proximate the lower portion of the drive tool.

5. The drive tool as recited in claim 1, further comprising handles proximate the upper portion of the drive tool.

6. The drive tool as recited in claim 1, further comprising adjustable height supports proximate the lower portion of the drive tool thereby allowing the drive tool to be adaptable to a variety of substrate profiles.

7. The drive tool as recited in claim 1, further comprising a feeder for automatically feeding fasteners to the lower portion of the drive tool.

8. The drive tool as recited in claim 1, further comprising a pair of tubes, wherein one tube telescopes from the other.

9. The drive tool as recited in claim 1, further comprising a nosepiece at the lower portion of the tool, said nosepiece having an opening through which the fastener extends.

10. The drive tool as recited in claim 9, further comprising at least one slot proximate the opening, said slot configured to allow passage of a head of the fastener therethrough.

11. The drive tool as recited in claim 1, wherein said stop structures comprise an upper split pin engaged with said threaded shaft and a lower split pin engaged with said threaded shaft.

12. The drive tool as recited in claim 11, wherein said upper split pin is adjustable.

13. The drive tools as recited in claim 1, further comprising foot pads on which an operator may stand, and handles proximate the upper portion of the drive tool.

14. The drive tool as recited in claim 13, wherein the foot pads are pivotable between a non-operating position and an operating position.

15. The drive tool as recited in claim 1, further comprising a second spring in said upper portion of said drive tool, said second spring providing that said drive tool can accommodate fasteners of varous lengths.

16. The drive tool as recited in claim 1, further comprising a pair of tubes, wherein one tube telescopes from the other, said pair of tubes comprising an upper tube and a lower tube, wherein a second spring is disposed in said upper tube, a tube cap is engaged with said upper tube, and said spring and said second spring are in contact with said tube cap.

* * * * *

UNITED STATES PATENT AND TRADEMARK OFFICE

CERTIFICATE OF CORRECTION

PATENT NO. : 6,296,064 B1
DATED : October 2, 2001
INVENTOR(S) : Michael Janusz and David C. Goss It is certified that error appears in the above-identified patent and that said Letters Patent is hereby corrected as shown below:

Column 1,
Line 1, "tie benefit" should be -- the benefit --

Column 6,
Line 3, "tie lower" should read -- the lower --

Signed and Sealed this

Seventh Day of May, 2002

*Attest:*

*Attesting Officer*

JAMES E. ROGAN
*Director of the United States Patent and Trademark Office*